United States Patent [19]

Murphy et al.

[11] 4,051,477

[45] Sept. 27, 1977

[54] WIDE BEAM MICROSTRIP RADIATOR

[75] Inventors: Lawrence R. Murphy, Longmont; Gary G. Sanford, Boulder, both of Colo.

[73] Assignee: Ball Brothers Research Corporation, Boulder, Colo.

[21] Appl. No.: 658,534

[22] Filed: Feb. 17, 1976

[51] Int. Cl.[2] ..... H01Q 1/38

[52] U.S. Cl. ..... 343/700 MS; 343/846

[58] Field of Search ..... 343/700 MS, 777, 778, 343/854, 846

[56] References Cited

U.S. PATENT DOCUMENTS

| | | | |
|---|---|---|---|
| 3,541,557 | 11/1970 | Miley | 343/767 |
| 3,710,338 | 1/1973 | Munson | 343/769 |
| 3,739,386 | 6/1973 | Jones | 343/708 |

*Primary Examiner*—Eli Lieberman

*Attorney, Agent, or Firm*—Cushman, Darby & Cushman

[57] ABSTRACT

A radio frequency antenna structure is disclosed wherein a raised pedestal portion of the ground plane surface is provided and above which pedestal portion a microstrip radiator is disposed. The microstrip radiator is thus disposed on a pedestal at a predetermined distance above the base ground plane to produce mirror image or apparent radiating aperture(s) therebelow. The combined radiation pattern from the real radiating aperture(s) and the mirrored image(s) thereof produces an increase in radiation power at low pointing angles located near the ground plane, thus producing a wider radiation beam without sacrificing radiation efficiency. This form of raised pedestal microstrip radiator is especially useful in phased arrays where it is desired to steer the beam of the array to angles near the ground plane itself.

14 Claims, 8 Drawing Figures

Fig. 1
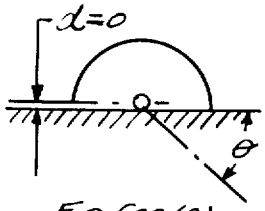
$E \sim \cos(0)$
Fig. 2
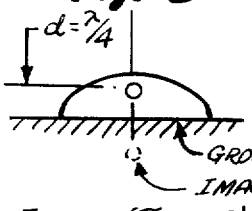
$E \sim \cos(\frac{\pi}{4}\cos\theta)$
Fig. 3
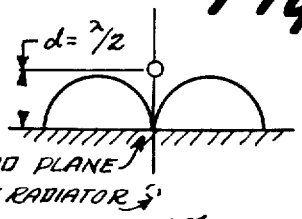
$E \sim \cos(\frac{\pi}{2}\cos\theta)$
Fig. 4
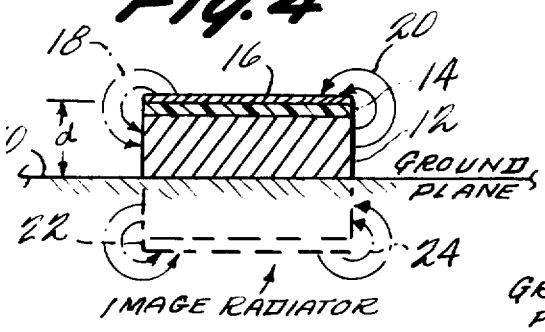
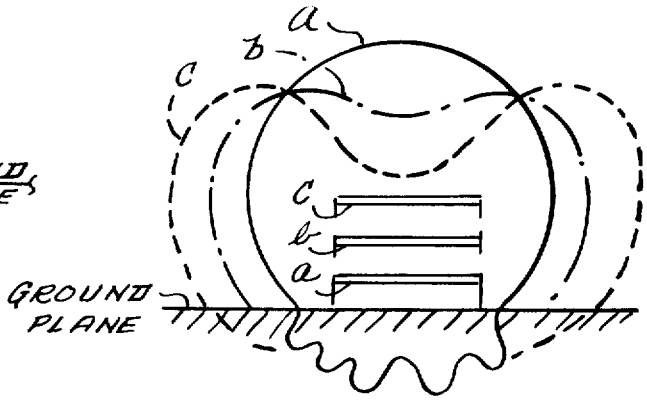
Fig. 5
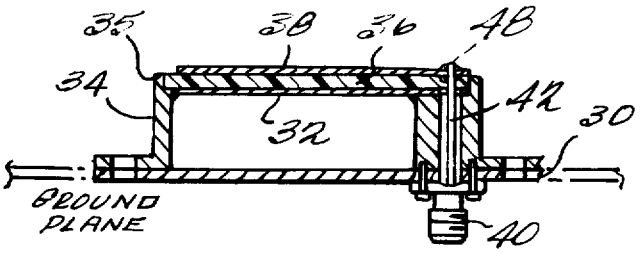
Fig. 6
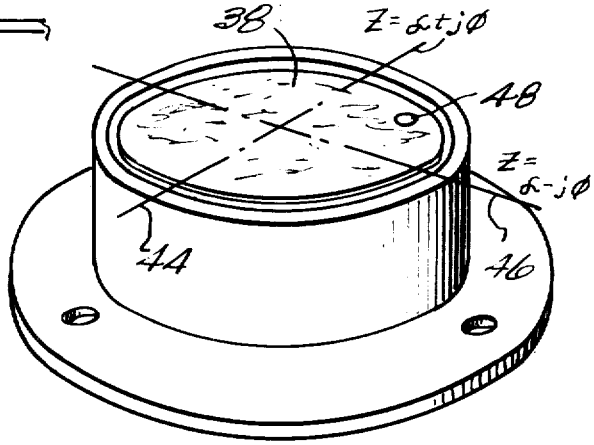
Fig. 7
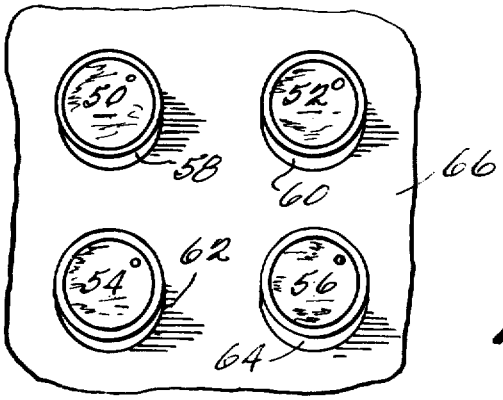
Fig. 8

WIDE BEAM MICROSTRIP RADIATOR

This invention generally relates to radio frequency antenna structures and, more particularly, to a structure wherein the microstrip radiators are mounted on raised pedestals from the usual ground plane surface and to arrays of such individual radiators mounted on raised pedestals distributed over a common ground plane surface.

Microstrip antenna structures of various types are now well known in the art by virtue of, inter alia, earlier already issued United States patents commonly assigned herewith such as U.S. Pat. Nos. 3,710,338; 3,713,166; 3,713,162; 3,810,183; 3,811,128; and 3,921,177. There are also other co-pending commonly assigned United States patent applications relating to various microstrip antenna structures such as, for instance, application Ser. No. 596,263 filed July 16, 1975; application Ser. No. 620,196 filed Oct. 6, 1975; and application Ser. No. 620,272, now U.S. Pat. No. 4,012,741 filed Oct. 7, 1975. Another commonly assigned co-pending application Ser. No. 666,174 filed Mar. 12, 1976 concerns the invention of Robert E. Munson and Gary G. Sanford for a high efficiency, low weight microstrip antenna structure.

It will be appreciated by those in the art that microstrip radiators, per se, are specifically shaped and dimensioned conductive surfaces overlying a larger ground plane surface and spaced therefrom by a relatively small fraction of an electrical wavelength by virtue of an interspersed dielectric material. Typically, microstrip radiators are formed either singly or in arrays by photo-etching processes exactly similar to those utilized for conventionally forming printed circuit board structures of desired electrically conductive surface shapes. In fact, the starting material used for manufacturing the usual microstrip radiator structures is quite similar to conventional printed circuit board stock in that it comprises a dielectric sheet laminated between two conductive sheets. Typically, one side of such laminated structure becomes the ground or reference plane for a microstrip antenna element or array while the other oppositely disposed surface of the laminated structure is photo-etched to form the actual shaped microstrip radiator or some array of such radiators usually integrally formed with an appropriate microstrip transmission feed line structure for conducting radio frequency energy to and from the radiating elements. It is, of course, understood that antenna radiating structures may be used for either reception or transmission of radio frequency energy as desired.

Accordingly, such typical prior microstrip radiators define a radiating aperture or apertures between the periphery of the radiating element and the underlying ground plane. As will be appreciated, the beam width of such radiator structures is inversely related to the aperture size and, accordingly, since the aperture size cannot be arbitrarily reduced without eventually reducing the radiating efficiency of the antenna structure, difficulty has been experienced in achieving wide beam radiation (i.e., at low radiation angles near the ground plane surface) at acceptable radiation efficiencies. It is also often desirable to provide a phased array of radiators having the capability of steering a beam of radiation from the array at relatively low radiation angles near the ground plane surface. Unless the individual radiators are also capable of efficiently radiating energy at such low angles, it is, of course, impossible to obtain the desired beam steering at such low angles with an array of radiators.

Now, however, it has been discovered that one may achieve such desired low angle, high efficiency radiation independent of the radiating aperture size by mounting the usual microstrip radiator structures on a pedestal formed in the ground plane surface, thereby creating an image radiator which can be used to modify the shape of the radiated beam from either a single radiator or from a phased array of such radiators disposed over a common ground plane surface.

This discovery permits control of the radiated beam shape from a single radiator substantially independent of the radiating aperture size. In particular, the beam shape may be controlled and widened so as to include the low radiation angles without materially reducing the radiation efficiency of the individual radiator or of a phased array of such radiators.

While the mounting of microstrip radiators on individually formed pedestals on the common ground plane necessarily complicates the usual microstrip radiator antenna structure, many of the commercial and technical advantages of microstrip radiators and/or arrays of microstrip radiators are still retained, thus making the resulting structure a highly advantageous one for many applications, as will be appreciated.

This invention is particularly useful in applications where hemispherical coverage is required. It will find use in applications where it is desired to modify the radiation pattern of a single element and/or in applications where an array of such elements is used to provide the wide element pattern required for steering the beam of the overall array to relatively low radiation angles near the ground plane surface.

By raising the individual microstrip radiators on raised pedestals in the underlying ground plane, nearly uniform gain may be achieved for relatively wide angles away from the antenna/array boresight. This desired effect is achieved by depressing the beam along the boresight direction and increasing the relative amounts of energy directed toward the broader "look angles." The resulting radiation pattern can be analyzed quantitatively for the case of an infinite ground plane by considering the total effect of the active radiating apertures and their mirror images having apparent locations below the ground plane surface.

The height of the raised pedestal in the underlying ground plane will vary for particular applications depending upon the degree to which one wants to emphasize the low radiation angles for the radiating element/array. However, in the usual applications, it will be desirable to locate the raised pedestal at approximately one-fourth wavelength to one-half wavelength above the base ground plane surface.

In the exemplary embodiment to be described below, a particular shape of circularly polarized microstrip radiator is depicted. However, it should be emphasized that this particular microstrip radiator is shown purely for exemplary purposes and that this invention relates to all types and shapes of linearly, circularly or elliptically polarized microstrip radiator structures.

Furthermore, in the exemplary embodiment to be described further below, an electrically conducting flange is disposed both to position the raised pedestal ground plane above the base ground plane surface and, at the same time, to electrically interconnect the two ground plane surfaces.

A more complete understanding and appreciation of this invention may be had by reading the following detailed description of the presently preferred exemplary embodiment thereof in conjunction with the accompanying drawings, of which:

FIGS. 1-3 are schematic, two-dimensional representations of linear antenna radiators disposed above an infinite ground plane for the purpose of theoretically explaining the operation of this invention;

FIG. 4 is a schematic drawing of a single microstrip antenna radiator according to this invention including a representation of a corresponding mirror image radiator produced thereby;

FIG. 5 is a schematic illustration showing the qualitative changes in radiation patterns from a microstrip radiator according to this invention as a function of its height above the ground plane;

FIGS. 6 and 7 are a cross-section and perspective view respectively of an exemplary embodiment of a microstrip radiator constructed according to this invention; and FIG. 8 is a perspective view of an array of microstrip radiators formed according to this invention.

There are, of course, many classical studies for a two-dimensional case of a linear radiator disposed at various distances above an infinite ground plane. The results of such a theoretical consideration are set forth in FIGS. 1, 2 and 3 for heights above the ground plane of zero, one-fourth wavelength and one-half wavelength respectively. As may be seen, as the line radiator is moved upwardly from the ground plane surface, the resulting radiation pattern is altered in shape so as to effectively decrease the proportion of radiated energy in a direction transverse to the ground plane and to increase the proportion of radiated energy occurring at lower radiation angles close to the ground plane surface itself. It should be appreciated that the mirror image radiators indicated as having apparent locations below the ground plane in FIGS. 2 and 3 will have a polarity opposite to that of the actual radiator disposed above the ground plane surface. It is the vector summation of the radiation fields from the actual radiator disposed above the ground plane surface and the virtual or mirror image radiator having an apparent location below the ground plane surface which gives rise to the total radiated field pattern as depicted in FIGS. 2 and 3.

Referring to FIG. 4, a large or theoretically infinite ground plane 10 is shown having superimposed thereon a conductive pedestal portion 12. A layer of dielectric material 14 separates this raised pedestal portion of the ground plane 12 from a microstrip radiator 16 lying thereabove. In this manner, radiating apertures are defined along either side of the microstrip radiator 16 and electromagnetic fields are caused to radiate from such apertures as shown by field lines 18 and 20 respectively. Since these radiating apertures are disposed a predetermined distance *d* above the base ground plane 10, virtual or mirror image radiating slots 22 and 24 respectively will appear to be present at an equal predetermined distance below the ground plane 10. Accordingly, the total radiated field from the microstrip radiator 16 will comprise the vector summation of radiations from both of the actual radiating slots as well as from the virtual radiation slots 22 and 24.

A qualitative representation of the radiation patterns obtained from the radiator 16 in FIG. 4 as a function of its height *d* above the ground plane is shown in FIG. 5 for three different radiator positions *a*, *b* and *c*. The resulting radiation patterns for these increasingly higher positions of the radiating apertures is shown by the field pattern lines *a*, *b* and *c*, respectively, which are also coded as solid and dotted lined contours for differentiation in FIG. 5. As will be appreciated from FIG. 5, the total portion of radiated energy increases at relatively low radiation angles along the ground plane surface as the height of the radiated apertures is increasingly raised above the ground plane surface. However, when the height of the radiating apertures reaches approximately one-half wavelength (as measured in the surrounding air dielectric medium) the radiation pattern in a direction transverse to the ground plane surface will be totally depressed and any further increase in height of the radiating apertures above the ground plane will cause the radiating pattern to break up into multiple lobes.

While the generation of such multiple lobes may have some useful end result for particular applications, it is presently preferred to avoid such multiple lobes and to maintain a more uniform and predictable radiation pattern from individual radiators by maintaining the height of the radiating apertures at less than one-half wavelength above the ground plane. On the other hand, in order to obtain a substantial increase in the proportion of radiated energy appearing at low radiation angles along the ground plane, it is also presently preferred to maintain the radiating apertures at approximately one-fourth wavelength or more above the ground plane surface.

It will also be understood that when a less than infinite ground plane is utilized, the actual radiation patterns will exhibit additional ripple caused by radiation from the ground plane edges.

One purely exemplary presently preferred embodiment of the invention is shown in FIGS. 6 and 7. Referring to the cross-section in FIG. 6, an underlying base or structural ground plane 30 is shown. Another raised pedestal electrically conducting ground plane surface 32 is also shown in FIG. 6. This raised portion of the ground plane 32 is both positioned above the ground plane 30 and electrically connected thereto by virtue of a flange 34 formed of an electrically conducting material such as copper, brass, aluminum, etc. It will be understood that other physical mounting arrangements and/or electrical connection arrangements could be utilized if desired.

A dielectric material 36 overlies the raised pedestal portion of the ground plane 32 and, in turn, a microstrip radiator or electrically conductive antenna element surface 38 is spaced from the raised pedestal portion of the ground plane 32 by the dielectric material 36. In this manner, at least one radiating aperture is defined between the periphery of the antenna element 38 and the raised pedestal ground plane 32 and/or its electrically common flange portion 34. In the exemplary embodiment, the flange 34 has an upper lip portion 35 which extends upwardly along the edge of dielectric 36. Actually, conductive surfaces 32 and 38 are quite thin and the dimensions of flange lip 35 are quite small with respect to a wavelength so that it is not critical whether flange lip 35 is present at all or whether it extends as shown.

A radio frequency input connector 40 is provided in FIG. 6 for feeding r.f. energy to/from the antenna element surface 38 via a feedline 42. Other conventional r.f. feed means could also be used as will be appreciated.

From the perspective view shown in FIG. 7, it will be appreciated that the microstrip radiator 38 is substantially circularly shaped. However, it is slightly "out of round" so as to provide complex conjugate r.f. impedances along mutually orthogonal axes. That is, the dimension of the radiator 38 along an axis 44 might be such as to provide an r.f. impedance of $\alpha + j\phi$ at the r.f. operating frequency of the antenna element while the dimension of the radiator 38 along axis 46 would differ from the dimension along axis 44 so as to provide the complex conjugate of r.f. impedance $\alpha - j\phi$ at the r.f. operating frequency. When this type of radiator is then fed with r.f. energy intermediate the axes, such as at a feed point 48, circularly polarized r.f. radiation will emanate from this antenna element. This type of circularly polarized r.f. microstrip radiator, per se, is a variation of the circularly polarized microstrip radiator structures, per se, as disclosed in prior commonly assigned U.S. Pat. No. 3,921,177. As should be appreciated, any type of microstrip radiator element may be utilized.

FIG. 8 shows an array of four individual microstrip radiators 50, 52, 54 and 56 mounted on pedestal ground planes 58, 60, 62 and 64 respectively rising from the common underlying base ground plane 66. As will be appreciated, such an array of any desired number of radiators would be phased so as to produce a composite beam pattern pointed in a desired direction. By using the raised pedestal microstrip radiator elements as shown, a greater proportion of radiated energy is available in such an array for direction at low pointing angles near the ground plane 66.

Although only a few specific exemplary embodiments of this invention have been described in detail, those skilled in the art will appreciate that many modifications and/or variations can be made in such exemplary embodiments without materially departing from the novel and advantageous features of this invention. Accordingly, all such modifications and/or variations are intended to be included within the scope of this invention as defined by the appended claims.

What is claimed is:

1. A radio frequency antenna structure which produces increased radiation power at low pointing angles near the ground plane without substantially sacrificing radiation efficiency, said structure comprising:

a base electrically conductive reference surface;

a raised pedestal electrically conductive reference surface disposed a predetermined distance above said base reference surface and electrically connected thereto;

dielectric material overlying said raised pedestal reference surface;

an electrically conductive antenna element surface spaced from said raised pedestal reference surface by said dielectric material defining an actual radiating aperture between the periphery of said antenna element surface and said raised pedestal reference surface while at the same time defining an image or virtual radiating aperture of like dimensions disposed below said base reference surface by said predetermined distance, said predetermined distance being related to the intended antenna operating frequency so as to shape the radiated pattern of fields and produce increased radiation power at low pointing angles near the base surface without substantially sacrificing radiation efficiency as compared to the case where said predetermined distance is reduced to zero; and r.f. feed means electrically connected to said antenna element surface for conducting r.f. energy to/from said antenna element surface.

2. A radio frequency antenna structure as in claim 1 further comprising an electrically conducting flange means disposed both to position said raised pedestal reference surface above the base reference surface and to electrically interconnect the two reference surfaces.

3. A radio frequency antenna structure as in claim 1 wherein said predetermined distance is less than one-half wavelength at the r.f. operating frequency of the antenna structure.

4. A radio frequency antenna structure as in claim 1 wherein said predetermined distance is more than one-fourth wavelength and less than one-half wavelength at the r.f. operating frequency of the antenna structure.

5. A radio frequency antenna structure comprising a plurality of structures as set forth in claim 1 wherein said plurality of structures all have a common base reference surface and are arranged in a predetermined phased array to produce a predetermined beam shaped pattern of r.f. radiation emanating from said array.

6. A radio frequency antenna structure as in claim 1 wherein said antenna element is electrically insulated around its periphery from said raised pedestal reference surface by said dielectric material thus forming a continuous radiating aperture thereabout.

7. A radio frequency antenna structure as in claim 1 wherein both said raised pedestal and said antenna element surface are substantially circularly shaped thereby causing said actual radiating aperture to be circularly shaped.

8. A radio frequency antenna structure as in claim 7 wherein said predetermined distance is more than one-fourth wavelength and less than one-half wavelength at the intended r.f. operating frequency of the antenna structure.

9. A radio frequency antenna structure comprising a plurality of structures as set forth in claim 8 wherein said plurality of structures all have a common base reference surface and are arranged in a predetermined phased array to produce a predetermined beam shaped pattern of r.f. radiation emanating from said array.

10. A radio frequency antenna structure comprising:

a base electrically conductive reference surface;

a raised pedestal electrically conductive reference surface disposed a predetermined distance above said base reference surface and electrically connected thereto;

dielectric material overlaying said raised pedestal reference surface;

an electrically conductive antenna element surface spaced from said raised pedestal reference surface by said dielectric material defining at least one radiating aperture between the periphery of said antenna element surface and said raised pedestal reference surface;

r.f. feed means electrically connected to said antenna element surface for conducting r.f. energy to/from said antenna element surface;

said antenna element surface being dimensioned differently in two mutually orthogonal axes so as to provide respectively corresponding different complex, r.f. impedances therealong; and said r.f. feed means being connected intermediate said axes so as to produce substantially circularly/elliptically polarized r.f. radiation emanating from said antenna element.

11. A radio frequency antenna phased array comprising:

a plurality of structures each of which structures comprise:

a base electrically conductive reference surface;

a raised pedestal electrically conductive reference surface disposed a predetermined distance above said base reference surface and electrically connected thereto;

dielectric material overlying said raised pedestal reference surface;

an electrically conductive antenna element surface spaced from said raised pedestal reference surface by said dielectric material defining at least one radiating aperture between the periphery of said antenna element surface and said raised pedestal reference surface; and r.f. feed means electrically connected to said antenna element surface for conducting r.f. energy to/from said antenna element surface;

said plurality of structures all having a common base reference surface and being arranged in a predetermined phased array to produce a predetermined beam shaped pattern of r.f. radiation emanating from said array;

each of said antenna element surfaces being dimensioned differently in two mutually orthogonal axes so as to provide respectively corresponding different complex r.f. impedances therealong, and said r.f. feed means being connected intermediate said axes so as to produce substantially circularly/elliptically polarized r.f. radiation emanating from said antenna element.

12. A radio frequency antenna structure as in claim 11 wherein said predetermined distance is more than one-fourth wavelength and less than one-half wavelength at the r.f. operating frequency of the antenna structure.

13. A radio frequency antenna structure as in claim 11 further comprising electrically conducting flange means disposed both to position each raised pedestal surface above the common reference surface and to electrically interconnect the reference surfaces.

14. A radio frequency antenna structure as in claim 13 wherein said predetermined distance is more than one-fourth wavelength and less than one-half wavelength at the r.f. operating frequency of the antenna structure.

* * * * *